US007341078B1

(12) United States Patent
Xia et al.

(10) Patent No.: US 7,341,078 B1
(45) Date of Patent: Mar. 11, 2008

(54) AUTOMATIC CONTAINER BULK FILLING PROCESS

(75) Inventors: Frank Zhi Shi Xia, Rancho Cucamonga, CA (US); Zhi Dong Lou, Rancho Cucamonga, CA (US); Jack Yong Feng Zhang, Rancho Cucamonga, CA (US); Mary Zi Ping Luo, Rancho Cucamonga, CA (US)

(73) Assignee: Amphastar Pharmaceuticals, Rancho Cucamonga, CA (US)

( * ) Notice: Subject to any disclaimer, the term of this patent is extended or adjusted under 35 U.S.C. 154(b) by 0 days.

(21) Appl. No.: 10/841,327

(22) Filed: May 10, 2004

(51) Int. Cl.
*B65B 31/00* (2006.01)

(52) U.S. Cl. ..... 141/8; 141/4; 141/66; 141/237; 53/432

(58) Field of Classification Search ..... 141/2, 141/4–8, 51, 65, 66, 85–91, 234, 237; 53/432
See application file for complete search history.

(56) References Cited

U.S. PATENT DOCUMENTS 1,922,458 A * 8/1933 Schaeffer ..... 53/432
3,282,306 A * 11/1966 Greenhut ..... 141/7
4,099,550 A * 7/1978 Matsuzaki et al. ..... 141/51
4,713,925 A * 12/1987 Kafkis ..... 53/432
6,418,982 B1 * 7/2002 Zhang et al. ..... 141/4

* cited by examiner

*Primary Examiner*—Timothy L. Maust
(74) *Attorney, Agent, or Firm*—Albert O. Cota

(57) ABSTRACT

An automatic bulk filling process for filling a large number of liquid containers (20) simultaneously which consists of placing the open-topped liquid containers upside down in a rack (22). The rack is then inserted into a vacuum chamber (28) and positioned directly above a tray (38) that contains a liquid medicinal product (40). The next step is to evacuate the chamber to a predetermined level below atmospheric pressure and then lowering the rack until the containers are partially immersed in the liquid product. Following that step, nitrogen is introduced into the vacuum chamber at a predetermined gradual rate, thereby quickly forcing the medicinal liquid product into the containers. The rack is then raised from the tray containing the liquid medicinal product and removed from the chamber as another rack full of containers is simultaneously inserted into the chamber from the other end.

2 Claims, 5 Drawing Sheets

AUTOMATIC CONTAINER BULK FILLING PROCESS

TECHNICAL FIELD

The invention pertains to bulk filling containers in general, and more specifically, to an automatic and continuous process for simultaneously drawing a liquid into a plurality of containers by surrounding the containers in a chamber. The chamber is capable of quickly reaching a desired vacuum level and introducing the liquid into a tray then reducing the vacuum and introducing nitrogen to force the liquid to be drawn into the container.

BACKGROUND ART

Previously, many traditional methods have been used to provide an effective means of filling containers with a liquid. The most common method is to utilize conveyors, where one or more tubes or hollow needles connected to a liquid-filled reservoir insert the liquid under pressure into the containers. The appropriate volume of liquid is usually controlled with valves or positive displacement pumps that modulate in sequence with the conveyor to insert the correct amount of liquid at the proper time. While this process is effective, the speed is normally limited to some 100 to 1,000 units per minute. This process is also expensive and in most cases is dedicated to a single product line. Another drawback of this process comes when filling smaller containers, especially containers having small openings. The time factor is expended when it comes to filling these containers, as a normal nozzle or hollow needle is limited in its diameter, as it can be no larger than the opening itself. The problem is amplified if the liquid to be filled is viscous.

A search of the prior art did not disclose any patents that read directly on the claims of the instant invention, however the following U.S. patents are considered related:

| U.S. Pat. No. | INVENTOR | ISSUE DATE |
|---|---|---|
| 6,418,982 | Zhang et al | Jul. 16, 2002 |
| 6,089,676 | Poynter et al | Aug. 8, 2000 |
| 4,114,659 | Goldberg et al | Sep. 19, 1978 |

My previous U.S. Pat. No. 6,418,982 discloses a process of bulk filling technology which includes the steps of arranging a number of containers upside down in a tray or rack. The trays or racks full of containers are then placed in a vacuum chamber, which is then evacuated to a predetermined level below atmospheric pressure. The container openings are then immersed in a liquid, and the vacuum within the chamber is gradually released to a predetermined level that draws the liquid into the containers. The trays or racks are then lifted above the liquid surface and the vacuum in the chamber is released.

U.S. Pat. No. 6,089,676 issued to Poynter et al discloses a process and apparatus for providing an air shower to a critical fill zone of a liquid filling operation for preventing entry of particulate, non-viable and viable particulate into the critical filling zone by providing opposed flows of pressurized air in laminar flows.

Goldberg et al. in U.S. Pat. No. 4,114,659 discloses a pipette filling and liquid dispensing device that is attached to a pipette by a flexible conduit. A resilient, compressible bulb is connected to the conduit, in which a closeable opening is provided. By means of the opening, an alternate connection may be established between the interior of the conduit and the opening by uncovering the opening. A valve unit is inserted into the conduit, and as it is releasably connected with the conduit, it is also easily removed.

For background purposes and as indicative of the art to which the invention is related reference may be made to the remaining patents located in the search:

| U.S. Pat. No. | INVENTOR | ISSUE DATE |
|---|---|---|
| 4,713,925 | Kaffis | Dec. 22, 1987 |
| 4,061,163 | Decker, et al | Dec. 6, 1977 |
| 3,282,306 | Greenhut | Nov. 1, 1966 |
| 2,877,611 | Anrep | Mar. 17, 1959 |

DISCLOSURE OF THE INVENTION

One of the prior art methods of filling containers incorporates the steps of arranging a number of containers upside down in a tray or rack and then pushing the containers into a vacuum chamber. The chamber is then evacuated to a predetermined level below atmospheric pressure. The open ends of the containers are immersed into the liquid and the vacuum within the chamber is gradually released to a predetermined level to draw the liquid into the containers. This bulk filling technology has many advantages but is limited to the size of vacuum chamber. The filling speed is also limited by the amount of manual labor that needs to be performed prior to and after each filling cycle. Another problem is the time it takes to reach the required vacuum level is slow, which can affect the stability or potency if medicinal liquid is the product to be filled. Since the prior process is exposed to more operator intervention, the integrity and quality of the filled product could easily suffer. The instant invention incorporates an automatic bulk filling process that provides an improvement over the prior art methods.

The inventive automatic process reduces the amount of manual labor required and also eliminates the need for a large vacuum chamber. This improved process increases productivity and reduces manufacturing costs. In addition, the filling chamber for the automatic bulk filling process is substantially smaller compared to the prior art described in the prior art patents. The prior art process typically requires a large volume chamber in order to fill a substantial number of containers in a cycle, which is required to compensate for the longer time it takes for subsequent processing. The time needed to reach the required vacuum level for the prior art process is slow because of the requirement for a large chamber. It is probable that the prolonged vacuum period may affect the stability or potency when the process involves filling a medicinal liquid product.

The inventive automatic bulk filling process fills a smaller quantity of containers during each filling cycle however, even though the quantity is smaller, the cycle is completed much faster. It has been found that the total amount of time required to complete a cycle is approximately 60 seconds from the moment the chamber door is opened to the point where racks of filled pipettes are pushed out of the chamber. The required vacuum level may be achieved in a very short amount of time in the small chamber size by utilizing two vacuum pumps of different capacity and two buffer tanks. High vacuum level is achieved by utilizing this process, which is necessary to minimize the size of air bubbles within the filled containers, to ensure product quality.

The automatic bulk filling method also provides convenience in subsequent processing or sealing the containers after the filling process by means of a push bar and conveyor mechanism. The mechanism automatically and continuously delivers and positions a rack of empty containers into the bulk sealing mechanism without the need of stopping or necessitating additional manual labor.

The filling cycle may be accomplished swiftly by the utilization of this automatic bulk filling process, thereby increasing efficiency and productivity. The required vacuum level is achieved rapidly due to the small chamber size and utilization of a rapid vacuum process which also ensures the potency and stability of the product.

In view of the above disclosure, the primary object of the invention is to create a process that can automatically and continuously fill a liquid product in an effective, efficient and convenient manner.

An important object of the invention is that the equipment is capable of quickly reaching the required vacuum level in order to ensure stability and potency of the liquid product, such as a medicinal product, during the filling cycle.

Another object of the invention is that the equipment is capable of reaching a high vacuum level necessary to minimize the size of air bubbles within the filled containers in order to ensure product quality.

Yet another object of the invention is that the equipment may be used for a wide variety of liquids and configurations of containers, as the containers only need to be placed in a rack upside down, thereby making the size and shape of both the containers and rack of little importance.

It is also a significant object of the invention to create filling equipment that requires minimum space and is easily installed, maintained and operated.

Yet another object of the invention to create a process and equipment that is cost effective from a manufacturing and consumer points of view.

Still another object of the invention is that the filled containers can be subsequently and continuously processed or sealed after the filling cycle.

The invention, in summary, is therefore directed to an improved process for bulk filling containers, which includes the steps of arranging a number of containers upside down in a rack and positioning the rack inside a vacuum chamber directly above a tray that contains a liquid medicinal product. The liquid medicinal product is introduced into a tray through a reservoir and conduit, which penetrates the wall of the vacuum chamber. The chamber is then evacuated to a predetermined negative pressure level below atmospheric pressure. The rack is then lowered until the container's necks are immersed in the liquid, and then nitrogen is introduced into the vacuum chamber to force the liquid product into the containers until the pressure reaches essentially atmospheric pressure. The level of the liquid in the tray is maintained by means of a control device, a liquid inlet valve, and a level sensor to ensure there is always sufficient liquid to fill all of the containers. The invention makes the filling process automatic and continuous, thus reducing the amount of manual labor required while eliminating the need for a large vacuum chamber.

Another improvement is in the ability to reach a high vacuum level in a very short amount of time. This significantly increases the speed of the filling process and improves productivity rate. The automatic bulk filling method is capable of generating high quality products, especially when it involves filling medicinal products, due to its ability to quickly reach the desired vacuum level, which ensures the stability and potency of the medicinal product. The rapid vacuum is achieved by utilizing two vacuum pumps of different capacity and two buffer tanks connected to the vacuum chamber.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
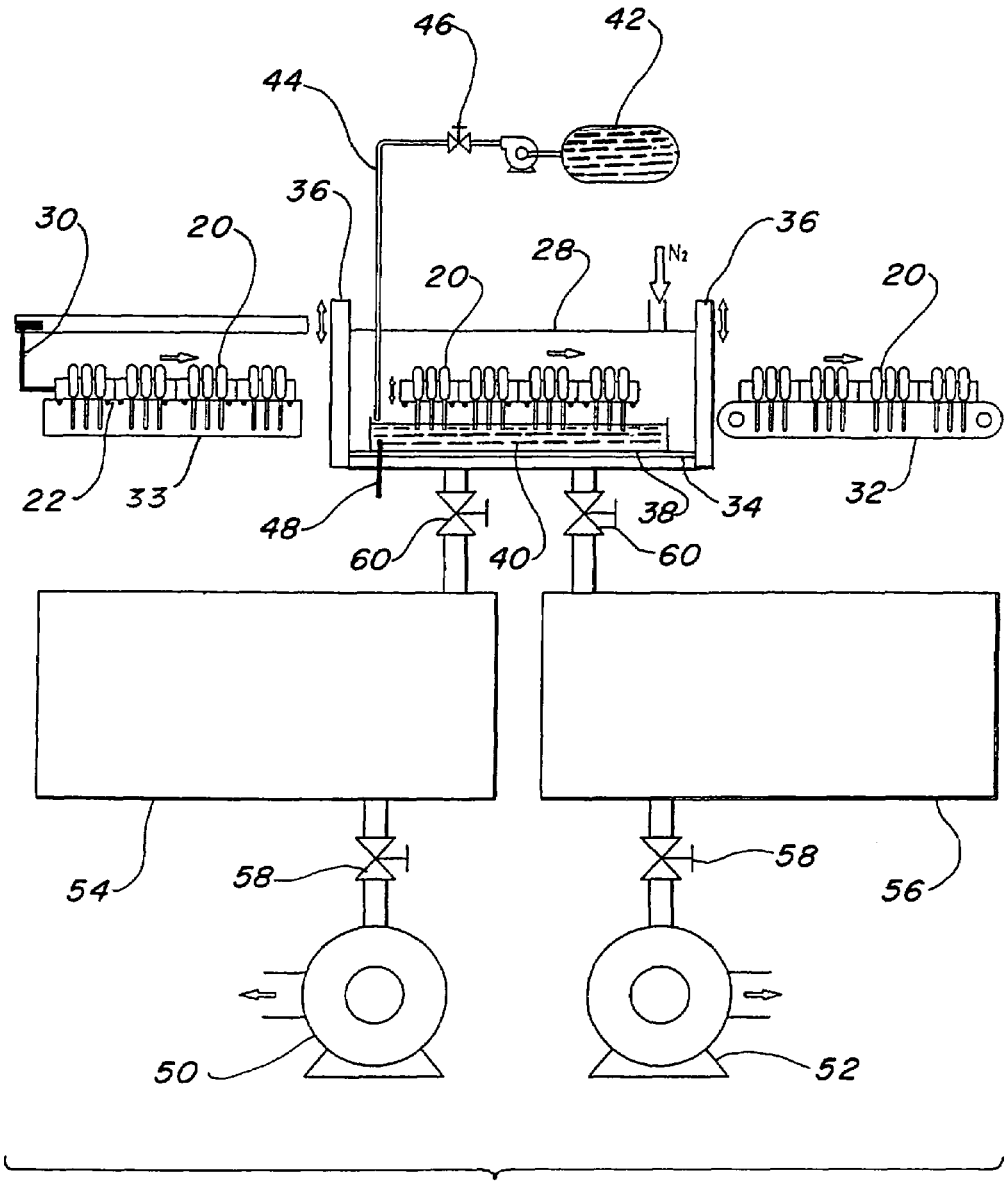
FIG. 1 is a schematic of the automatic bulk filling process which comprises all of the major elements such as: a vacuum chamber, conveyor, rack, tray, a pair of fast open-close doors, vacuum pumps, buffer tanks, inlet and outlet valves, a reservoir and a conduit.
Figure 2:
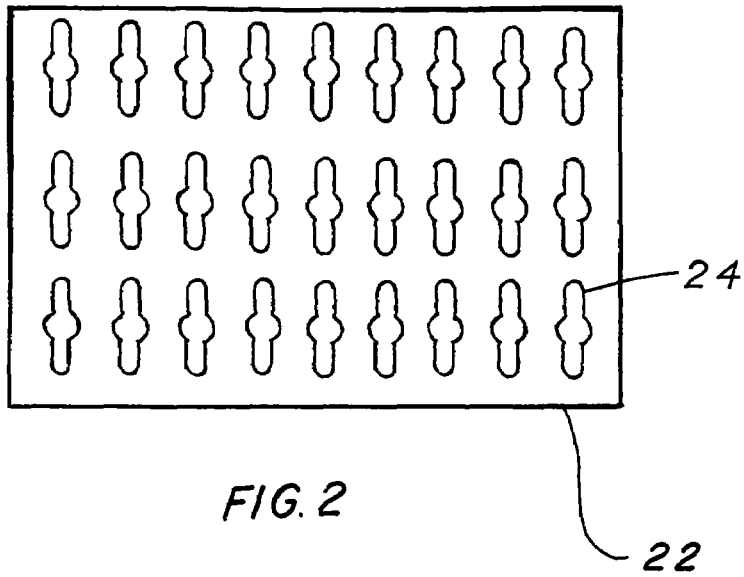
FIG. 2 is a top view of the rack that contains multiple openings that accept and secures the containers in a proper position.
Figure 3:
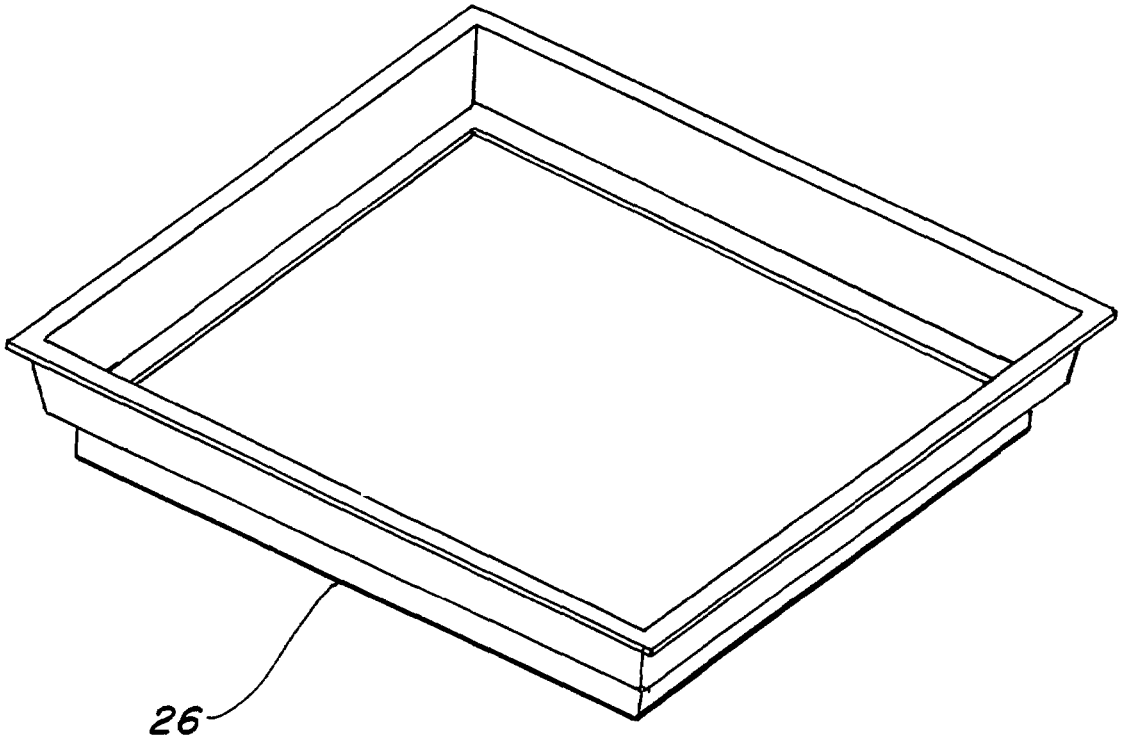
FIG. 3 is a partial isometric view of the frame completely removed from the invention for clarity.
Figure 4:
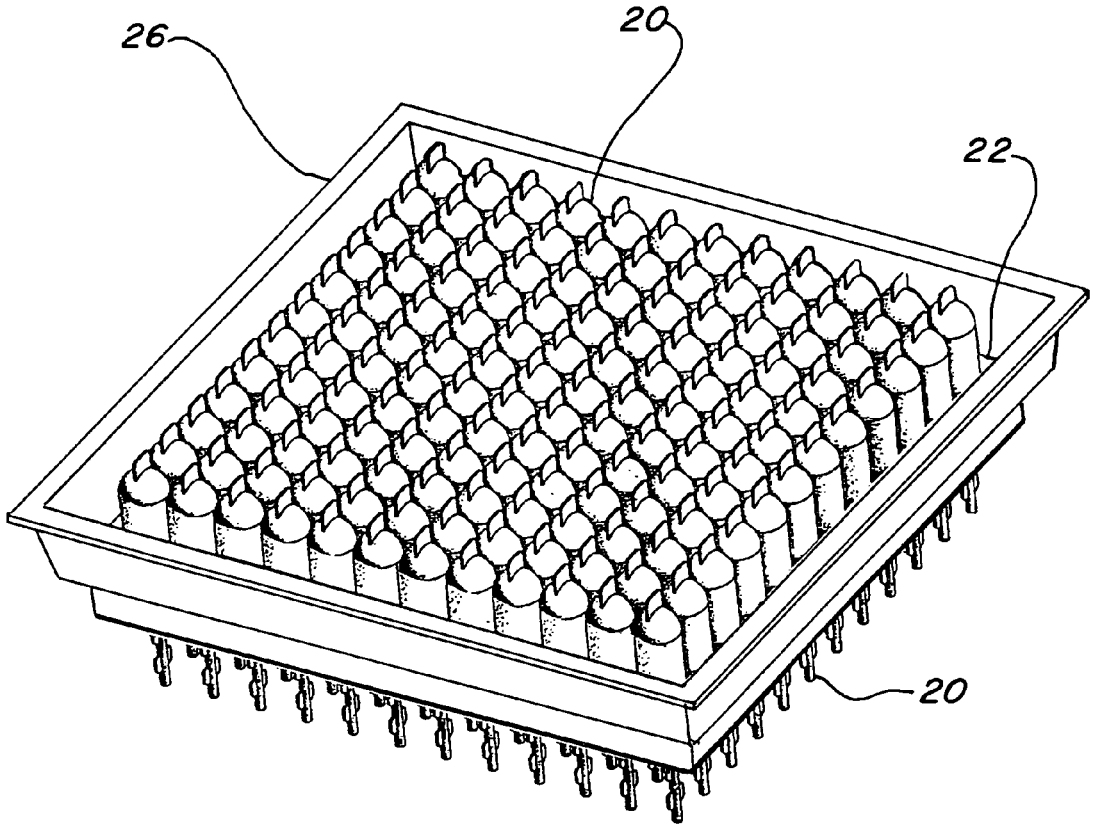
FIG. 4 is a diagram showing a number of containers arranged in the proper configuration within a rack.
Figure 5:
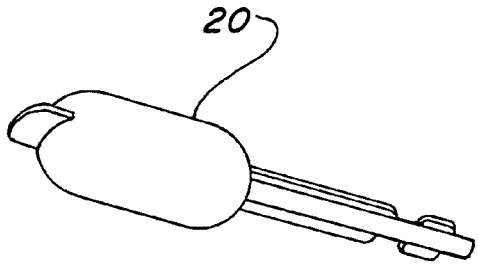
FIG. 5 a partial isometric view of one of the open topped containers.
Figure 6:
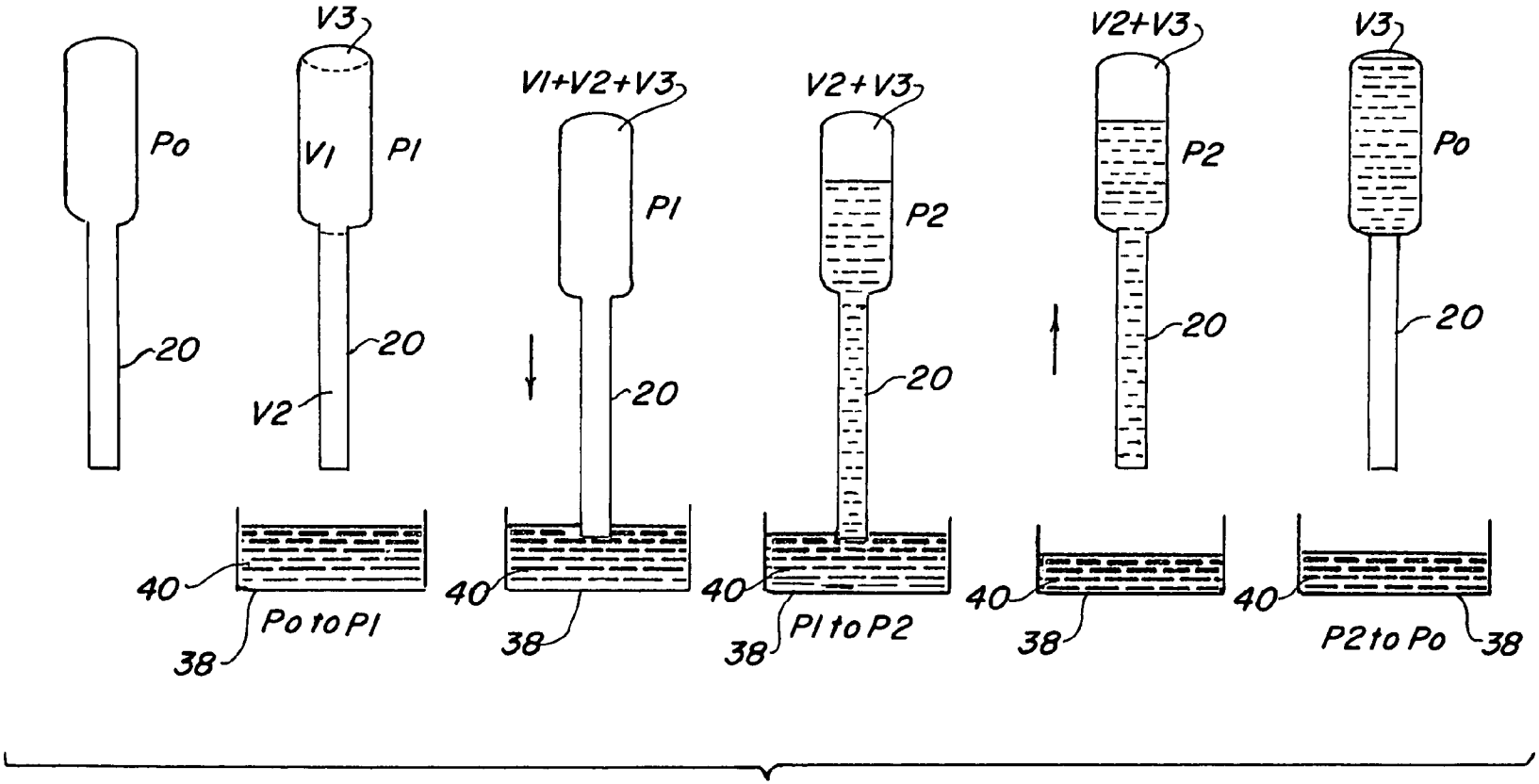
FIG. 6 is a representative diagram of the filling process that comprises the positioning of the containers above the tray that contains the liquid product, reducing the pressure, introducing the container's neck into the tray contains the liquid product, and releasing the vacuum to draw the liquid into the containers.

The best mode for carrying out the invention is presented in terms of a preferred embodiment for an automatic container bulk filling process as shown in FIGS. 1 through 7. The process automatically bulk fills a plurality of liquid containers simultaneously. The first step of the process starts by placing a number of open topped liquid containers 20 upside down in a rack 22. The rack 22 includes a plurality of openings 24 such that the containers 20 are adjacent to each other remaining in a spaced relationship. The openings 24 in the rack 22 are illustrated in FIG. 2, and are in the same basic shape as the container 20 only slightly larger and preferably slotted with a round shape in the middle to conform the contour of a container 20 having opposed wings on each side of a round neck, as illustrated in FIG. 5. The rack 22 may be fabricated of any material, such as thermoplastic or metal and is inserted into a rack flame 26, as depicted separately in FIG. 3 and combined in FIG. 4, with the frame 26 providing structural integrity to the rack 22.

The next step is to insert the combined rack 22 and frame 26 into a vacuum chamber 28, as illustrated in FIG. 1. Insertion is accomplished by urging the rack 22 with a push bar 30 onto the rails 33 with rollers, thereby allowing the rack 22 to slide easily into the chamber 28. The rack 22 is then slid onto guide rails 34 integrally formed within the vacuum chamber 28. The vacuum chamber 28 has a fast open-close door 36 on both its inlet and outlet in order to achieve a rapid bulk filling process. The vacuum chamber 28 also includes a tray 38 containing a liquid medicinal product 40, as illustrated in FIG. 1, that is fabricated of any material, such as thermoplastic or metal, as long as it has a peripheral lip of a height to hold sufficient liquid.

An additional supplementary step automatically fills the tray 38 with the liquid medicinal product 40 to maintain a serviceable level during the entire automatic bulk filling process. The required amount of liquid medicinal product 40 is introduced into the tray 38 by utilizing a reservoir 42, with a conduit 44 in the form of a pipe or a tube, penetrating the wall of the vacuum chamber 28 and aligned in such a manner as to be inside the lip of the tray 38. The amount of liquid medicinal product 40 required to fill the containers 20 and maintain the proper level is controlled by utilizing control devices, such as a liquid inlet valve 46 and a level sensor 48. Other methods may also be utilized for volume control purposes, such as a flow meter and weight scale. In any event, the tray 38 is filled with a predetermined amount of liquid medicinal product 40 in sufficient quantity to fill all the containers 20 simultaneously while maintaining a level such that the container's neck is always immersed during the filling process. Further methods for to automatically filling include gravity feeding or pressurizing with a pump as pictorially illustrated in FIG. 1, but not specifically designated.

The next step is positioning the rack 22 directly above the tray 38 containing the liquid medicinal product 40. The vacuum chamber 28 is then evacuated to a predetermined level below atmospheric pressure. The fast open-close door 36 will be automatically closed to seal the vacuum chamber 28 once the rack 22 is in the proper position. The vacuum chamber 28 is evacuated using both a low vacuum pump 50 and a high vacuum pump 52 in communication with a low vacuum buffer tank 54 and a high vacuum buffer tank 56. Inlet valves 58 are located between the vacuum pumps 50-52 and buffer tanks 54-56, and two outlet valves 60 are positioned between the buffer tanks 54-56 and the vacuum chamber 28. Initially, the two vacuum pumps 50-52 are operated with the inlet valves 58 connecting the vacuum pumps 50-52 to the buffer tanks 54-56 open, and the other two outlet valves 60 closed. The two vacuum pumps 50 and 52 remain working at all times during the filling process. The two inlet valves 58 connecting the vacuum pumps 50-52 to the buffer tanks 54-56 will always remain open as well during the filling process. This is a necessary procedure in order to allow the buffer tanks to be prepared and ready to evacuate the vacuum chamber 28 during the next cycle. The two vacuum pumps 50-52 have different capacity capabilities, with the low vacuum pump 50 capable of reaching rough/low vacuum level rapidly but unable to reach a high vacuum level. The high vacuum pump 52 is capable of reaching medium vacuum or even a higher vacuum level but is typically slower in the process. A high vacuum level of approximately 0.05 atmospheres may be achieved in a short amount of time, typically within 4-8 seconds, by combining and utilizing the two pumps 50-52 and buffer tanks 54-56 concurrently. The low vacuum pump 50 is utilized to draw the majority of the air out of the filling chamber to quickly reach a low vacuum level, and the high vacuum pump 52 draws the remaining air out of the vacuum chamber 28 in order to reach the required or higher vacuum level.

The vacuum process is critical for the filling cycle for a number of reasons. A high vacuum level needs to be achieved in order to minimize the size of the air bubbles within the filled containers 20. The existence of air bubbles will provide a possibility for molecule movement, which will affect product quality. The size of air bubbles can be controlled by using the following formula:

$$P_1 = \frac{V_3}{(V_1 + V_2 + V_3)} \times P_0 \tag{1}$$

Where:

$P_1$=absolute pressure in the chamber right before filling $P_0$=ambient pressure $V_1$=Volume of the product in container $V_2$=Volume of container neck $V_3$=Volume of air bubble With the ambient pressure constant and the volume of the container fixed, the volume of the air bubble will be proportional to the vacuum level or absolute chamber pressure. A higher vacuum level or lower chamber pressure will result in a smaller bubble size. The vacuum level is closely monitored to avoid pressure above the liquid vapor saturation, which will cause water to evaporate. This is why a short or quick vacuum period is also crucial, because prolonged vacuum period will cause instability if the liquid medicinal product 40 is to be filled, which also affects the potency of the mendicant. Further, the short amount of time of the vacuum process helps reduce the time of a filling cycle. A fast filling cycle is critical as it increases production efficiency and reduces manufacturing costs. The automatic bulk filling method is capable of completing a cycle, from the moment the filling chamber door is opened and the rack is pushed in, to the point where the racks full of filled containers are pushed out of the chamber, in approximately 60 seconds.

Once the buffer tanks are ready, the outlet valve 60 connecting the low vacuum buffer tank 54 to the vacuum chamber is opened in order to evacuate the vacuum chamber 28. The outlet valve 60 is then closed immediately after the rough/low vacuum level is reached and the second outlet valve 60 is opened that connects the vacuum chamber 28 to the high vacuum buffer tank 56. The two outlet valves 60 cannot be opened at the same time in order to achieve the required vacuum level. The inner connection between the vacuum chamber 28 and buffer tanks 54-56 through either outlet valve 60 lasts for approximately 4 seconds. This leaves sufficient time, after the valves are closed, for the vacuum pumps 50-52 to prepare the buffer tanks 54-56 for the next filling cycle. The vacuum chamber 28 reaches the required vacuum level in a short amount of time because the volumes of the two buffer tanks 54-56 are considerably larger than the volume of the vacuum chamber 28.

As an example, assume that the volume of Tank 54, Tank 56 and Vacuum Chamber 28 are $V_A$, $V_B$, and $V_C$ respectively. Typically, $V_A$=$V_B$. Define $P_A^o$ and $P_A$ as starting pressure and ending pressure for Tank 54. Define $P_B^o$ and $P_B$ as starting and ending pressure for Tank 56. Define $P_o$ as the environmental pressure, typically $P_o$=1 and $P_1$ is specified by Eq. (1). Thus, $$P_A = \frac{P_A^o \cdot V_A + V_C}{V_A + V_C} \tag{2}$$

$$P_B = P_1 = \frac{P_{B^O} \cdot V_B + P_A \cdot V_C}{V_B + V_C} \tag{3}$$

$$\text{Let, } \beta = V_A/V_C = V_B V_C \tag{4}$$

Eq. (2) becomes, $$P_A = \frac{P_A^o \cdot \beta}{\beta+1} + \frac{1}{\beta+1} \tag{5}$$

Substitute Eq. (4) and (5) into Eq. (3) to generate the following equation, $$P_1 = k \cdot P_A^o + b \tag{6}$$

where, $$k = \frac{\beta}{(\beta+1)^2} \tag{7}$$

$$b = \frac{1}{(\beta+1)^2} + \frac{P_B^o \cdot \beta}{\beta+1} \tag{8}$$

Eq. (6) shows that $P_1$, also the ending pressure of Tank 56, depends on starting pressures $P_A^o$ and $P_B^o$ and the system structure parameter β.

For a fixed β and $P_B^o$, $P_1$ is a simple linear function of $P_A^o$ as given explicitly by Eq. (6).

Using β=15 and Eq. (5) and (6), $P_A$ and $P_B$ (i.e. $P_1$) are calculated for some typical $P_A^o$ and $P_B^o$ as shown in the following table:

TABLE 1

End Pressure (vacuum) $P_1$ with different $P_A^0$ and $P_B^0$

| | $P_A^0 = 0.30$ | $P_A^0 = 0.25$ | $P_A^0 = 0.20$ | $P_A^0 = 0.15$ | $P_A^0 = 0.10$ | $P_A^0 = 0.09$ | $P_A^0 = 0.08$ | $P_A^0 = 0.07$ | $P_A^0 = 0.06$ |
|---|---|---|---|---|---|---|---|---|---|
| $P_B^0 = 0.08$ | 0.096 | 0.094 | 0.091 | 0.088 | 0.085 | 0.084 | 0.084 | 0.083 | 0.082 |
| $P_B^0 = 0.07$ | 0.087 | 0.084 | 0.081 | 0.078 | 0.075 | 0.075 | 0.074 | 0.074 | 0.073 |
| $P_B^0 = 0.06$ | 0.078 | 0.075 | 0.072 | 0.069 | 0.066 | 0.065 | 0.065 | 0.064 | 0.064 |
| $P_B^0 = 0.05$ | 0.068 | 0.065 | 0.063 | 0.060 | 0.057 | 0.056 | 0.055 | 0.055 | 0.054 |
| $P_B^0 = 0.04$ | 0.059 | 0.056 | 0.053 | 0.050 | 0.047 | 0.047 | 0.046 | 0.046 | 0.045 |
| $P_B^0 = 0.03$ | 0.050 | 0.047 | 0.044 | 0.041 | 0.038 | 0.037 | 0.037 | 0.036 | 0.036 |
| $P_B^0 = 0.02$ | 0.040 | 0.037 | 0.034 | 0.031 | 0.029 | 0.028 | 0.027 | 0.027 | 0.026 |
| $P_B^0 = 0.01$ | 0.031 | 0.028 | 0.025 | 0.022 | 0.019 | 0.019 | 0.018 | 0.017 | 0.017 |
| $P_B^0 = 0.005$ | 0.026 | 0.023 | 0.020 | 0.017 | 0.014 | 0.014 | 0.013 | 0.013 | 0.012 |

Figure 7:
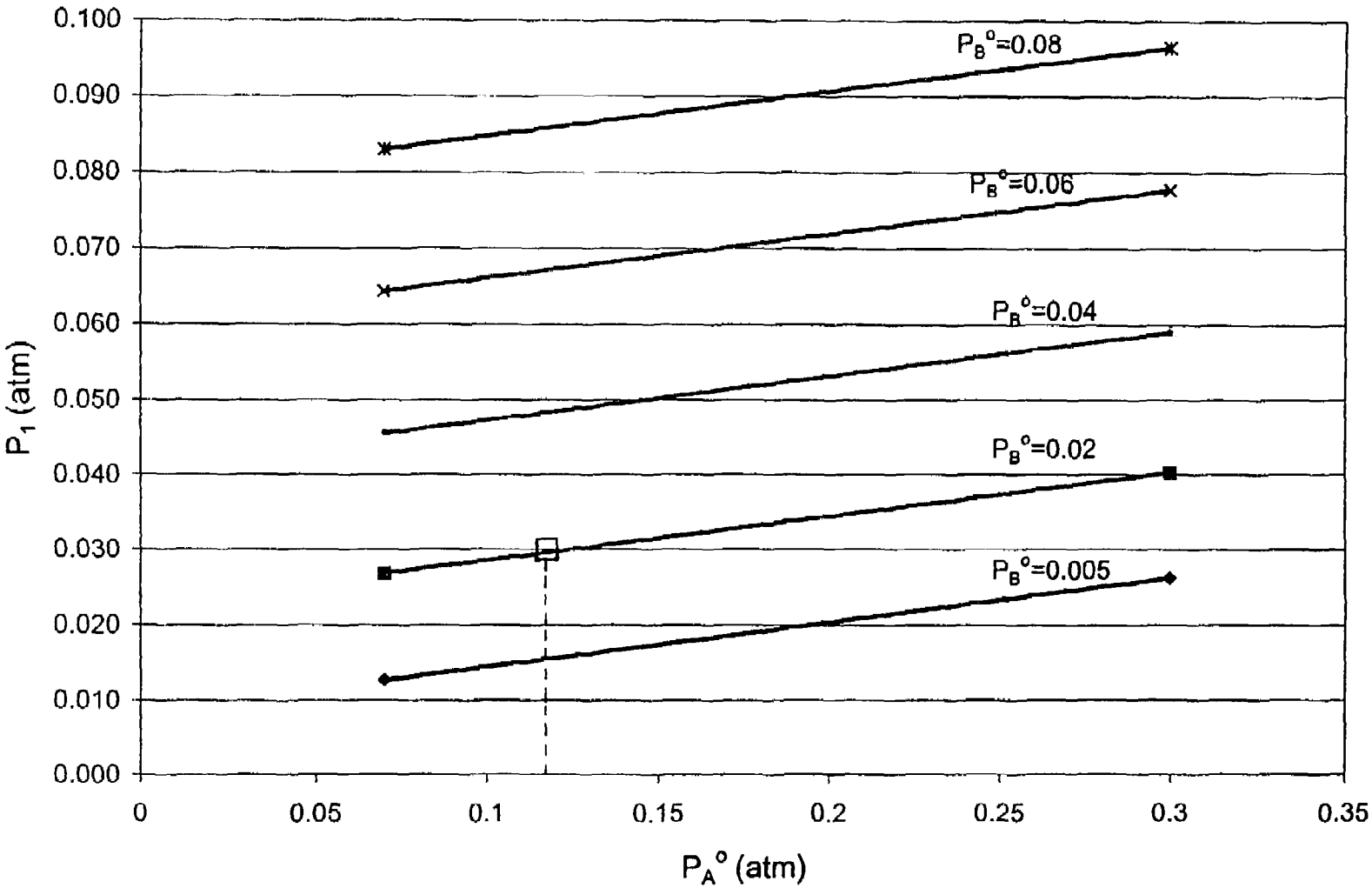
FIG. 7 is a plot of Chamber Vacuum vs. Starting Vacuum in the high pressure and low pressure buffer tanks.

FIG. 7 shows the linear relationship between the filling chamber vacuum and the starting vacuum in buffer tank A and tank B. The plot is also helpful to select a suitable vacuum pump.

Based on the container 20 structure and Eq. (1), $P_1$ is usually predetermined. For example, if $P_B^o$=0.02 atm is selected, from the plot of FIG. 7, $P_A^o \approx 0.12$ atm is required for pump 50 to obtain $P_1$=0.03 atm. Any liquid ring high flow vacuum pump 52 will be suitable for this process.

The following step in the process is lowering the rack 22 into the tray 38 until the containers 20 engage and partially immerse said liquid product 40, as illustrated in FIG. 1. This step permits the product 40 to be drawn into the container 20 and to increase the speed of the process. The next step comprises introducing an inert gas, such as nitrogen, into the vacuum chamber 28 at a predetermined gradual rate which quickly draws the medicinal liquid product 40 into the individual containers 20.

Once the containers 20 are filled the following step is accomplished by raising the rack 22 from the tray 38 containing the liquid product 40. The liquid product 40 remains inside since it is almost completely full. The subsequent step is removing the rack 22 with the then filled containers 20 from the vacuum chamber 28 as another rack 22 full of containers 20 is simultaneously inserted into the vacuum chamber 28. Removing the rack 22 is easily accomplished by urging the filled container rack 22 with the push bar 30 similar to that on the inlet side and a conveyor mechanism 32 away from the vacuum chamber 28 to facilitate rapid processing.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An automatic bulk filling process for simultaneously filling liquid containers which comprises the steps of:

a) placing a plurality of open-topped liquid containers upside down in a rack, b) inserting said rack into a vacuum chamber, c) positioning said rack directly above a tray containing a liquid medicinal product, d) evacuating said vacuum chamber to a predetermined level below atmospheric pressure, e) reducing the pressure within said vacuum chamber with a first vacuum pump and a second vacuum pump with each having a different capacity, and two buffer tanks with each having an inlet valve and an outlet valve for quickly reaching the desired vacuum level of the process, f) lowering said rack until said containers are partially immersed in said liquid product, g) introducing nitrogen into said vacuum chamber at a predetermined gradual rate, thereby forcing said medicinal liquid product into said containers, h) raising said rack from said tray containing said liquid medicinal product, and i) removing said rack with filled containers as another rack full of containers is simultaneously inserted into said vacuum chamber.

2. An automatic bulk filling process for simultaneously filling liquid containers which comprises the steps of:

a) placing a plurality of open-topped liquid containers upside down in a rack, b) inserting said rack into a vacuum chamber, c) positioning said rack directly above a tray containing a liquid medicinal product, d) evacuating said vacuum chamber to a predetermined level below atmospheric pressure, e) reducing the pressure within said vacuum chamber with a first vacuum pump and a second vacuum pump with each having a different capacity, and two buffer tanks with each having an inlet valve and an outlet valve for quickly reaching the desired vacuum level of the process, wherein said first vacuum pump and said second vacuum pump further comprise the step of reducing the pressure, with the first vacuum pump capable of rapidly reaching a rough/low vacuum level and said second pump capable of reaching a high vacuum, f) lowering said rack until said containers are partially immersed in said liquid product, g) introducing nitrogen into said vacuum chamber at a predetermined gradual rate, thereby forcing said medicinal liquid product into said containers, h) raising said rack from said tray containing said liquid medicinal product, and i) removing said rack with filled containers as another rack full of containers is simultaneously inserted into said vacuum chamber.

* * * * *